US006386500B1

(12) United States Patent
Dainoff et al.

(10) Patent No.: US 6,386,500 B1
(45) Date of Patent: May 14, 2002

(54) BOOK AND COPY HOLDER

(75) Inventors: Marilyn Hecht Dainoff, Cincinnati; Richard H. Prigozen, Dayton, both of OH (US)

(73) Assignee: Dainoff Designs, Inc., Cincinnati, OH (US)

( * ) Notice: Subject to any disclaimer, the term of this patent is extended or adjusted under 35 U.S.C. 154(b) by 0 days.

(21) Appl. No.: 09/528,119

(22) Filed: Mar. 17, 2000

Related U.S. Application Data

(60) Provisional application No. 60/124,783, filed on Mar. 17, 1999.

(51) Int. Cl.[7] ..... A47B 97/04

(52) U.S. Cl. ..... 248/451; 248/456; 248/460

(58) Field of Search ..... 248/451, 441.1, 248/446, 449, 453, 452, 454, 456, 455, 460

(56) References Cited

U.S. PATENT DOCUMENTS

| | | | | | |
|---|---|---|---|---|---|
| 456,089 | A | | 7/1891 | Harrison | |
| 634,922 | A | | 10/1899 | Waldrip | |
| 1,045,747 | A | | 11/1912 | Richendrfer et al. | |
| 1,485,786 | A | * | 3/1924 | Kraft | 248/460 |
| 1,923,351 | A | * | 8/1933 | Woodley | 248/456 |
| 2,224,530 | A | * | 10/1940 | Weinstein | 211/43 |
| 2,374,409 | A | * | 4/1945 | Brennan | 248/453 |
| 2,583,097 | A | | 1/1952 | Heimann | |
| 2,591,170 | A | | 4/1952 | Levinson et al. | |
| 3,272,183 | A | * | 9/1966 | Craighead et al. | 248/453 |
| 3,381,928 | A | * | 5/1968 | White | 248/455 |
| 3,991,967 | A | | 11/1976 | Sack | |
| 4,518,140 | A | * | 5/1985 | Ferranto | 248/456 |
| 4,531,642 | A | * | 7/1985 | Racich | 211/42 |
| 4,685,647 | A | * | 8/1987 | Calhoun | 248/444.1 |
| 5,054,736 | A | | 10/1991 | Champoux | |
| 5,290,002 | A | * | 3/1994 | Cohen | 248/456 |
| 5,290,003 | A | * | 3/1994 | Reyes | 248/461 |
| D358,611 | S | | 5/1995 | Dainoff et al. | |
| D367,377 | S | | 2/1996 | Langston et al. | |
| 5,516,072 | A | * | 5/1996 | Shinno | 248/460 |
| D372,371 | S | | 8/1996 | Grove, Jr. | |
| D380,629 | S | * | 7/1997 | Shinno | D6/449 |
| 5,651,525 | A | * | 7/1997 | Yang | 248/456 |
| D428,753 | S | * | 8/2000 | Crothall et al. | D6/630 |

* cited by examiner

*Primary Examiner*—Anita King
(74) *Attorney, Agent, or Firm*—SAIDMAN DesignLaw Group

(57) ABSTRACT

A book or copy holder is disclosed having a base, a rack and a shelf. The base includes a pair of parallel, elongated slots formed therein and cut at a different angles relative to the top surface of the base. The rack includes a flat front surface having several elongated slots formed therein which extend through the rack and a tab extending from the bottom edge of the rack. The tab is complimentarily in shape to the slots formed in the base, so that the rack is supported in a stable, inclined position when the tab is inserted into one of the slots formed in the base. The shelf includes a tab extending from its rear edge which is complimentarily in shape to the slots formed in the rack, so that the shelf may be supported in a stable position when the tab is inserted into one of the slots.

34 Claims, 13 Drawing Sheets

BOOK AND COPY HOLDER

CROSS REFERENCE TO RELATED APPLICATION

This application claims the benefit of prior U.S. Provisional Application Ser. No. 60/124,783 filed Mar. 17, 1999.

BACKGROUND

1. Field of the Invention

The present invention relates to a book and copy holder for supporting books, papers, cards, etc., in an upright position for hand-free reading.

2. Description of the Related Art

As used herein, the term "copy holder" refers to a device for supporting printed material, such as books, papers, cards, etc., in an upright position.

Copy holders are well-known in the art. Conventional copy holders typically include an inclined rack having a flat surface against which printed materials are received and retained, means for holding the printed material in place, such as a clip, shelf, or ledge, and a base for supporting the rack in one or more inclined positions.

OBJECTS AND SUMMARY OF THE INVENTION

It is an object of the present invention to provide a copy holder that is simple and inexpensive to manufacture.

It is another object of the present invention to provide a copy holder that is aesthetically pleasing.

It is yet another object of the present invention to provide a copy holder capable of being stored flat.

It is an object of the present invention to provide a copy holder that is simple to adjust.

Another object of the present invention is to provide a copy holder that is easy to assemble and disassemble.

The foregoing and other objects are achieved in accordance with the present invention through the provision of a copy holder comprising a base, a rack, and a shelf. The base preferably includes a pair of parallel, elongated slots formed therein and support feet attached to its bottom surface. The base optionally includes a pencil well located on its top surface. The rack includes a flat front surface having several elongated slots formed therein which extend through the rack and a tab extending from the bottom edge of the rack. The tab is complimentarily in shape to the slots formed in the base, so that the rack is supported in a stable, inclined position when the tab is inserted into one of the slots formed in the base. Preferably, each of the slots formed in the base is cut at a different angle relative to the top surface of the base, for example, 60 and 80 degrees, respectively. The slots formed in the rack are preferably orthogonal to the front surface of the rack, parallel to one another and evenly spaced. The shelf includes a tab extending from its rear edge. The tab is complimentarily in shape to the slots formed in the rack, so that the shelf may be supported in a stable position when the tab is inserted into one of the slots. Having several slots formed in the rack allows the shelf to be positioned at a number of locations along front surface of the rack.

BRIEF DESCRIPTION OF THE DRAWINGS

The present invention will be fully appreciated as the same becomes understood from the following detailed description of the best mode presently contemplated for carrying out the present invention when viewed in conjunction with the accompanying drawings, in which.

DETAILED DESCRIPTION OF THE PREFERRED EMBODIMENTS

Figure 1:
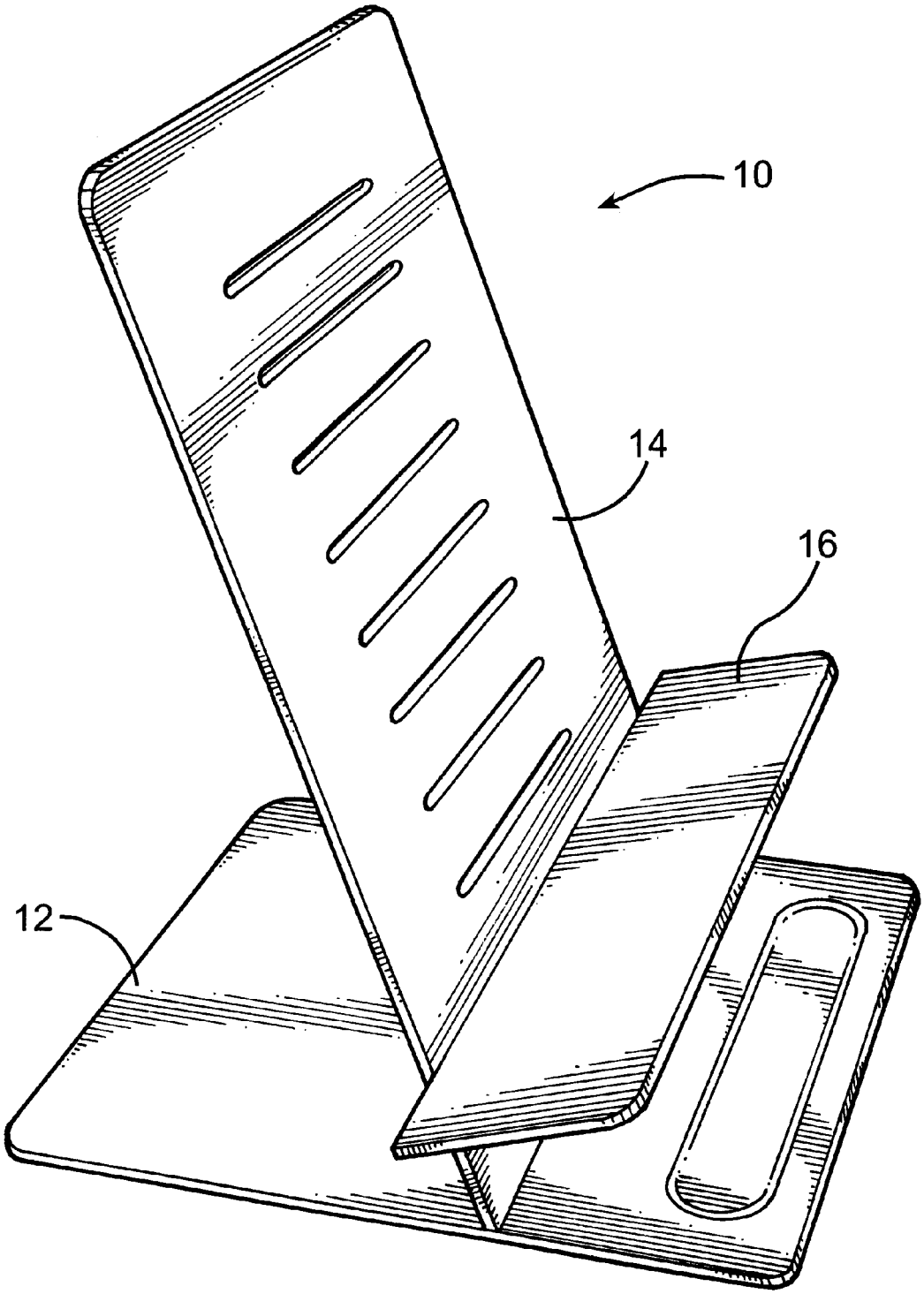
FIG. 1 is a perspective view which illustrates a preferred embodiment of the book and copyholder of the present invention that includes a base, a rack, and a shelf.

Referring to FIG. 1, a book and copy holder 10 is shown in a perspective view in its assembled state. Holder 10 comprises a base 12, a rack 14 against which a book may rest, and a shelf 16 for supporting a book.

Figure 2:
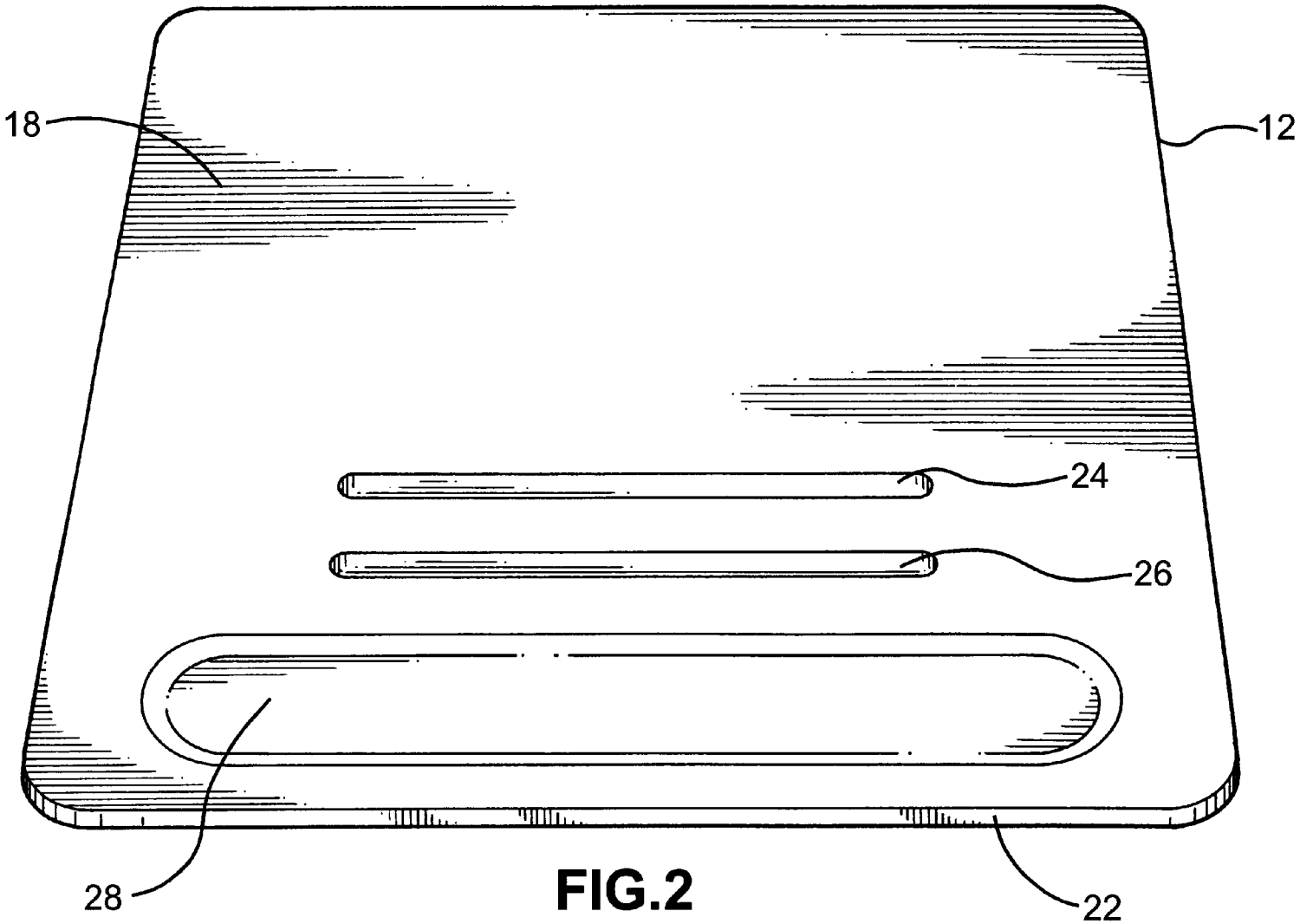
FIG. 2 is a top view of the base.
Figure 3:
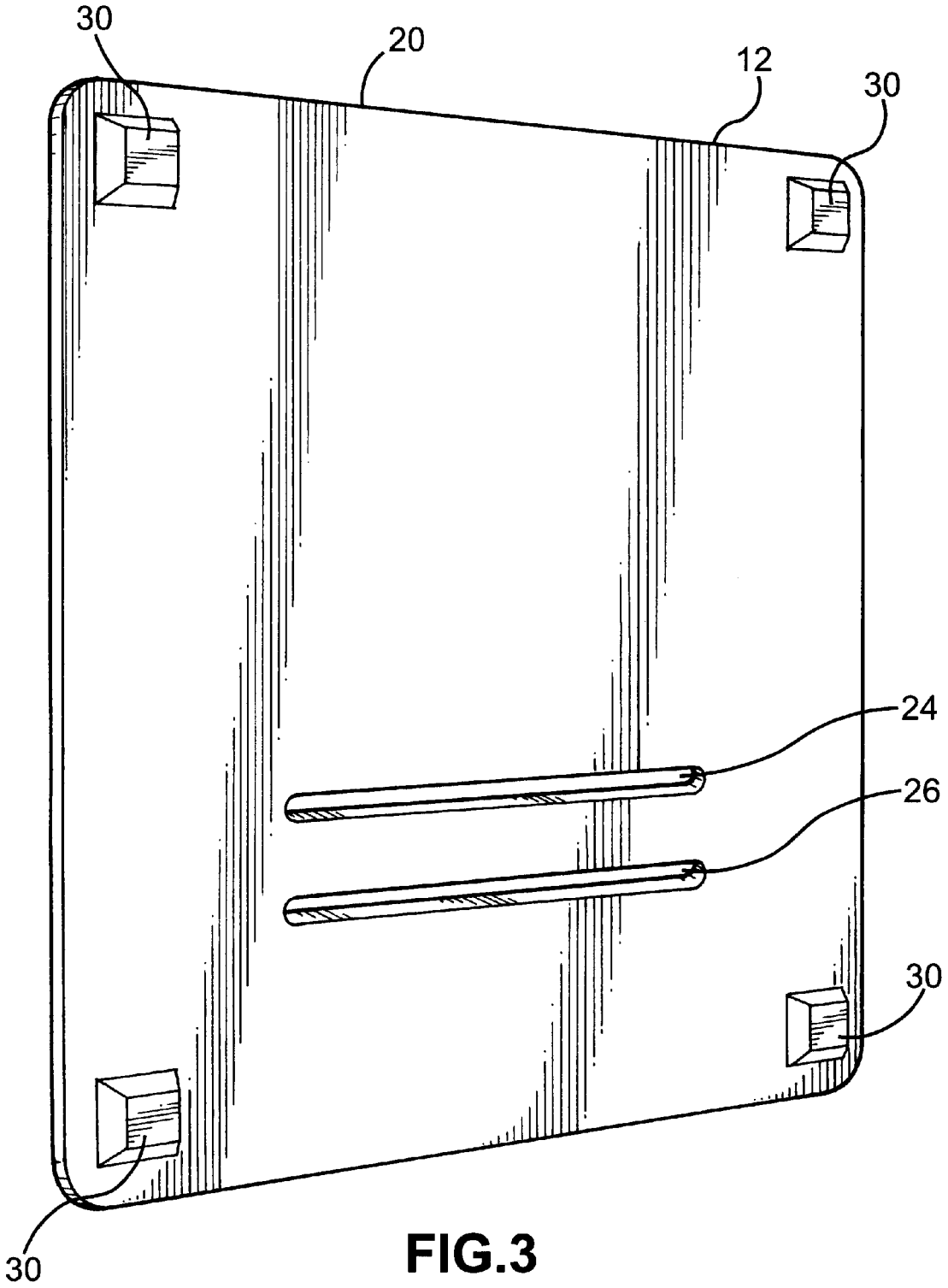
FIG. 3 is a bottom view of the base.

Base 12 has a top surface 18 shown in FIG. 2 while the bottom surface thereof is shown in FIG. 3. Base 12 more particularly comprises a flat panel 22, preferably made of heavy-duty plastic. Top 18 and bottom surface 20 are parallel to each other. A pair of substantially parallel slots 24 and 26 extend through panel 22 and are closed at both ends. The sidewalls of slots 24 and 26 do not extend orthogonally through panel 22 but rather extend in acute angles relative to top surface 18 and back surface 20, a different angle for each slot. Slot 24 is preferably angled approximately 60 degrees from the horizontal, and slot 26 is preferably angled approximately 80 degrees from the horizontal. The difference in angles allows rack 14 to assume different rakes relative to base 12. While two slots are preferred, any number of slots having any desired angles may be provided. A pencil well 28 is preferably recessed into top surface 18 in front of slots 24 and 26.

The bottom surface 20 of base 12 is shown in FIG. 3 where slots 24 and 26 are more clearly seen. Support feet 30 are preferably affixed to bottom surface 20, and are preferably made of a skid-resistant material, e. g., rubber, to prevent holder 10 from sliding on the surface 32 (FIGS. 6–8 and 11) of a counter, desk, table, etc.

Figure 4:
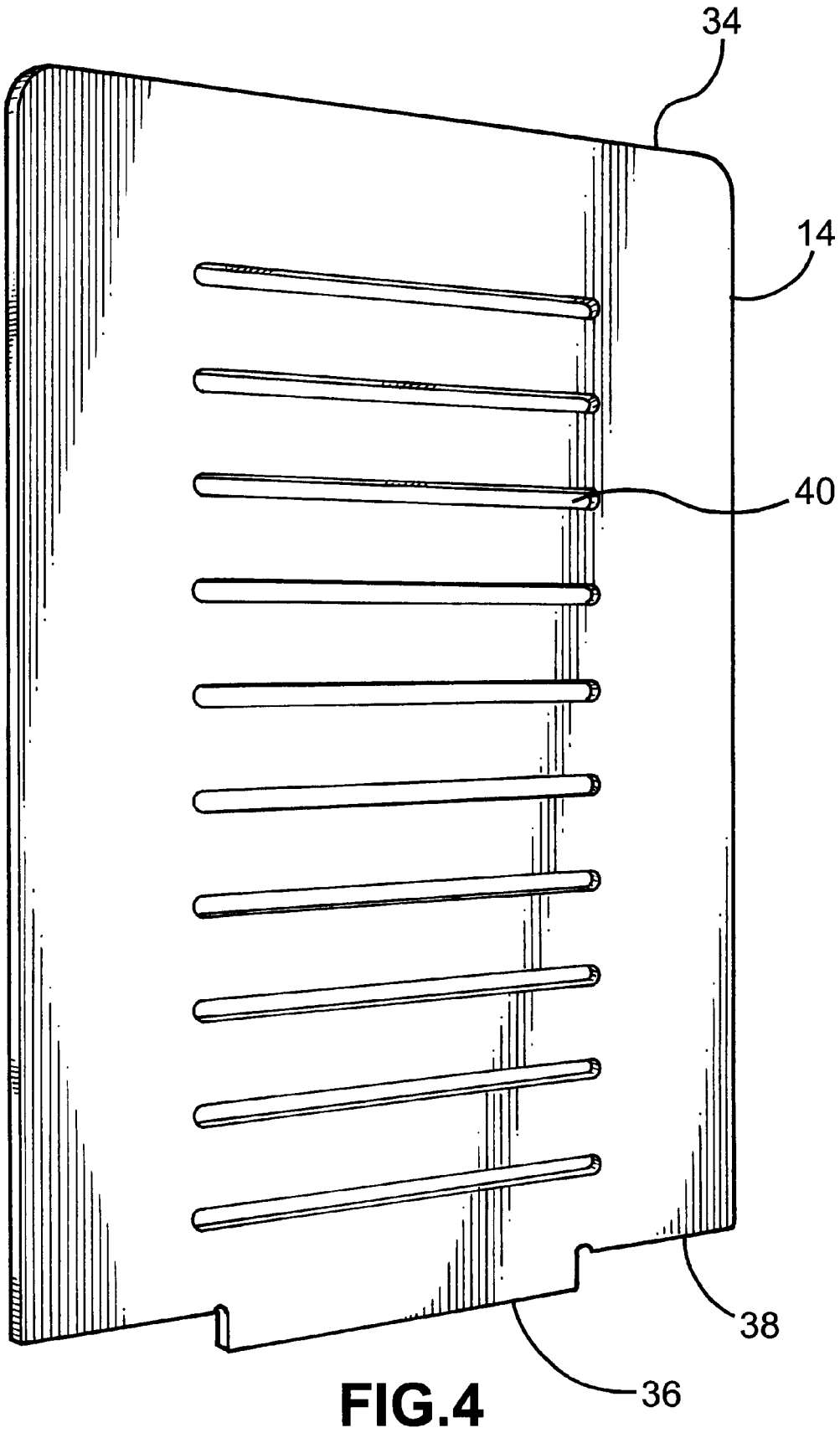
FIG. 4 is a front view of the rack.

A front view of rack 14 is shown in FIG. 4. Rack 14 preferably comprises a flat panel 34 made of the same heavy-duty plastic as base 12. A tab 36 is centrally located along and extends from the bottom edge 38 of rack 14 and is parallel to the front of rack 14. The length and thickness of tab 36 are commensurate with the length and width of slots 24 and 26 of base 12 so that it fits snugly therein. The height of tab 36 is sufficient to extend completely through base 12. Preferably, the height of tab 36 is a little more than twice the thickness of panel 22; this assures a stable configuration when rack 14 is installed on base 12, as seen in FIGS. 1, 6–8, and 11–12. Support feet 30 on base 12 are of sufficient height that tab 36 does not touch surface 32.

Rack 14 preferably has a plurality of laterally centered slots 40 extending therethrough. Unlike slots 22 and 24, slots 40 are preferably formed orthogonally through rack 14.

Figure 5:
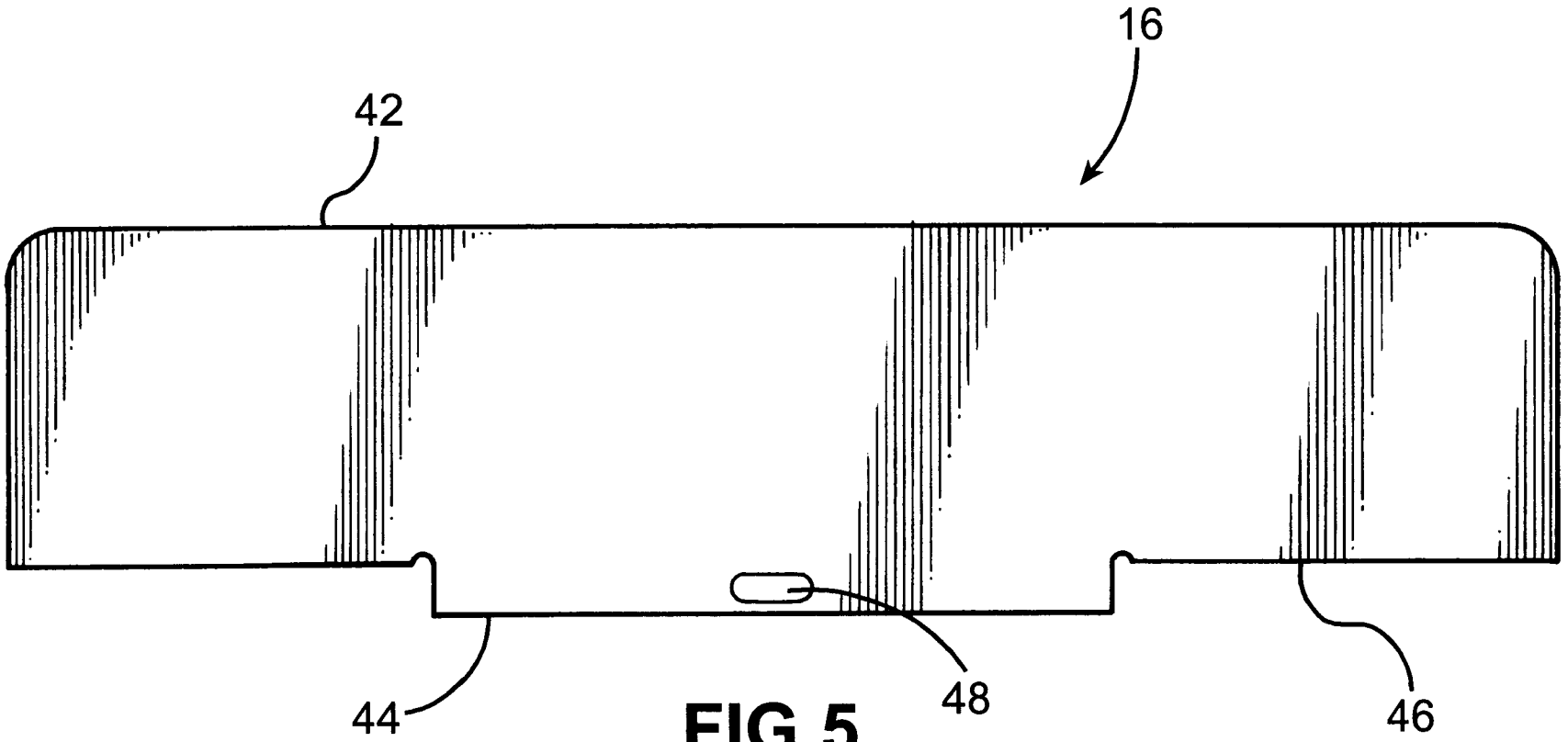
FIG. 5 is a top view of the shelf.

Shelf 16 is shown in FIG. 5 and comprises a flat panel 42 preferably made of the same heavy-duty plastic as base 12 and rack 14. All three panels 22, 34, and 42 are preferably of the same thickness. A tab 44 is centrally located along and extends from bottom edge 46 of shelf 16. It is sized to fit snugly into one of the slots 40 of rack 14. The height of tab 44 is sufficient to extend completely through rack 14. Like tab 36, the height of tab 44 is a little more than twice the thickness of rack 14; this assures a stable configuration when shelf 16 is installed on rack 14.

An aperture 48 is provided in tab 46. At least a portion of aperture 48 extends beyond the back of rack 14 and is accessible to allow a locking device (not shown), for instance, a small, inclined wedge, to secure shelf 16 to rack 14. Shelf 16 is stable without a locking device, but the capability of securely fastening it to rack 14 is present if needed. Of course, tab 36 of rack 14 could also include a similar aperture to secure it to base 12, if desired.

Returning to FIG. 1, it may be appreciated that base 12, rack 14, and shelf 16 are separate, unconnected structures. When assembled, they form book and copy holder 10. Assembly is achieved simply by placing tab 36 in one of slots 24 or 26 and placing tab 44 in one of slots 40. Holder 10 is disassembled by the reverse procedure, i.e., by removing tabs 36 and 44 from slots 24/26 and 40, respectively. Inasmuch as assembly/disassembly involves only sliding tabs into/from slots, the time needed for it is measured in seconds. When disassembled, base 12, rack 14, and shelf 16 are easily stored, or may be transported in a bookbag or the like, since they are all flat panels. When assembled, holder 10 is a stable support for books of all sizes and kinds.

Figure 6:
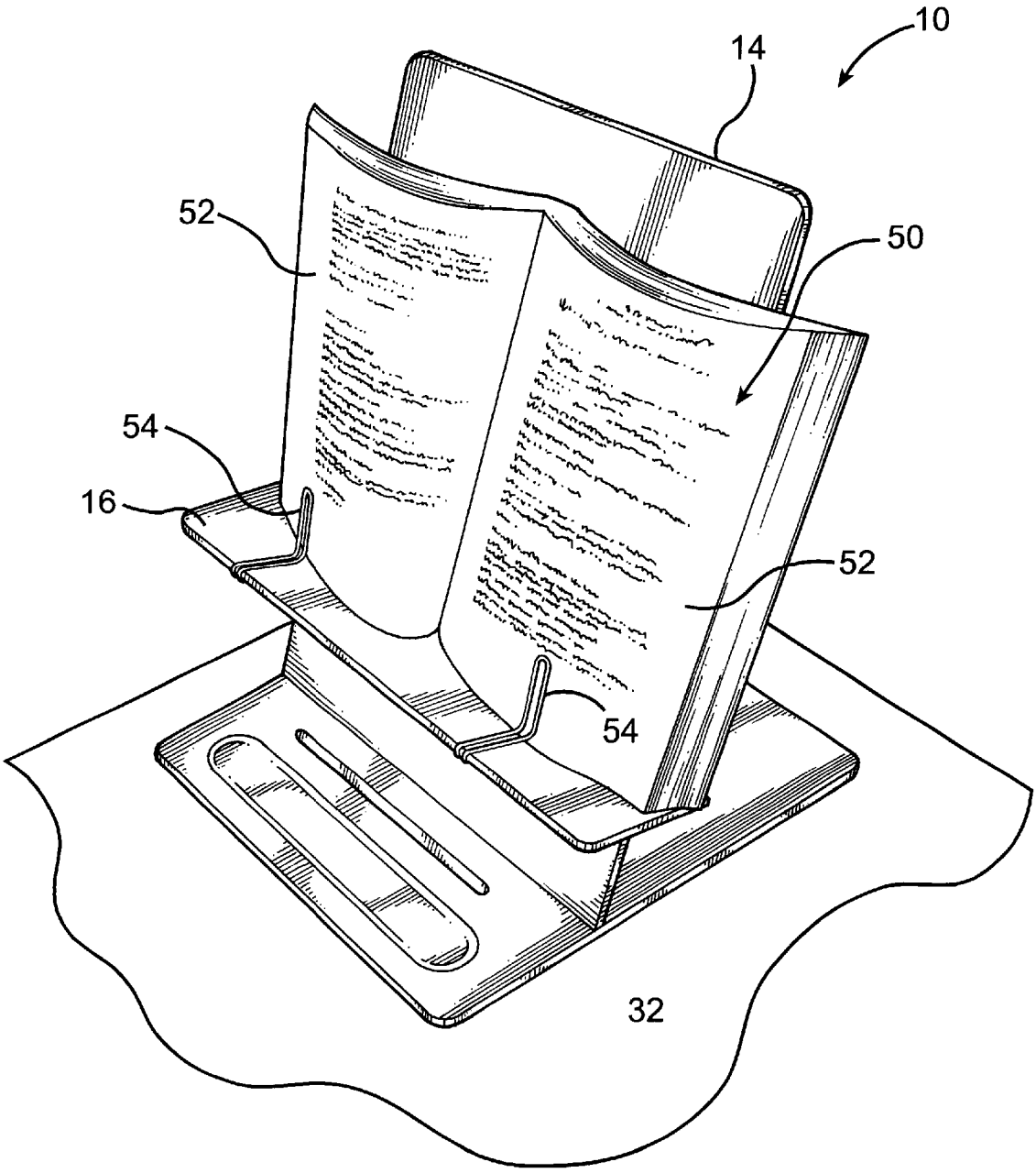
FIG. 6 is a perspective view of a book on the book and copy holder with a pair of page stopper clips holding the pages thereof.
Figure 7A:
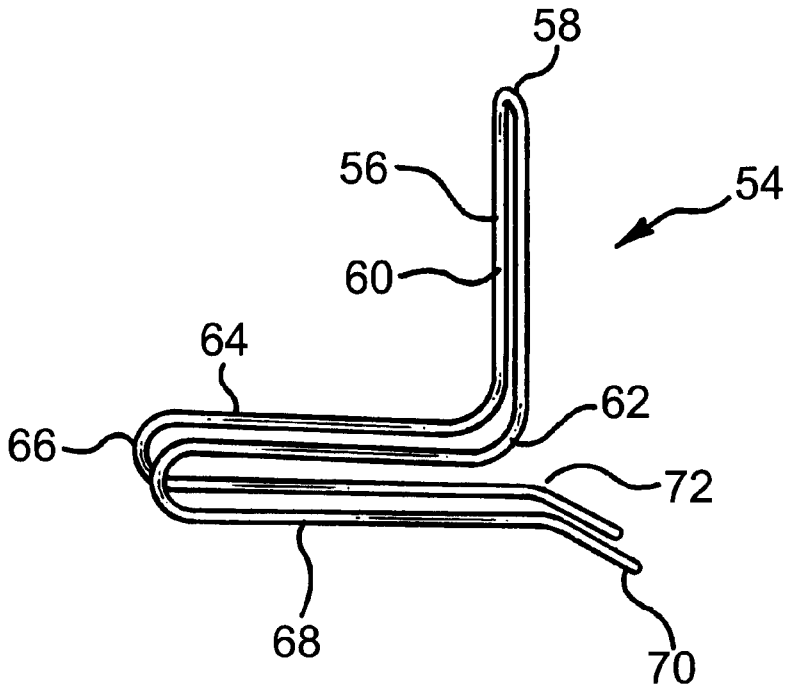
FIG. 7A is a perspective view of the page stopper clip.
Figure 7B:
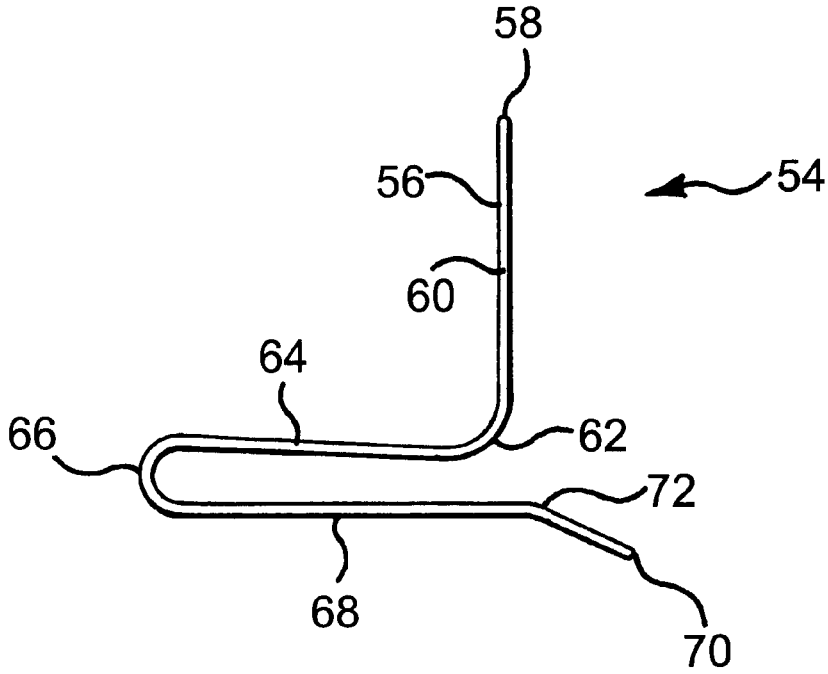
FIG. 7B is a side view of the page stopper clip.

FIG. 6 is a perspective view of holder 10 supported by surface 32. A book 50 rests on shelf 16 and leans against rack 14. Because of the angles of slots 24 and 26, rack 14 is inclined relative to top surface 18 and bottom surface 20, and thereby to surface 32. Inasmuch as slots 40 are perpendicular to rack 14, shelf 16 is also inclined relative to surface 32, albeit offset by 90°. Book 50 is, therefore, supported by holder 10 at an angle relative to surface 32. The angles of slots 24 and 26 are selected based on ergonomic principles such that book 50 will be stable and easy to read.

Figure 8:
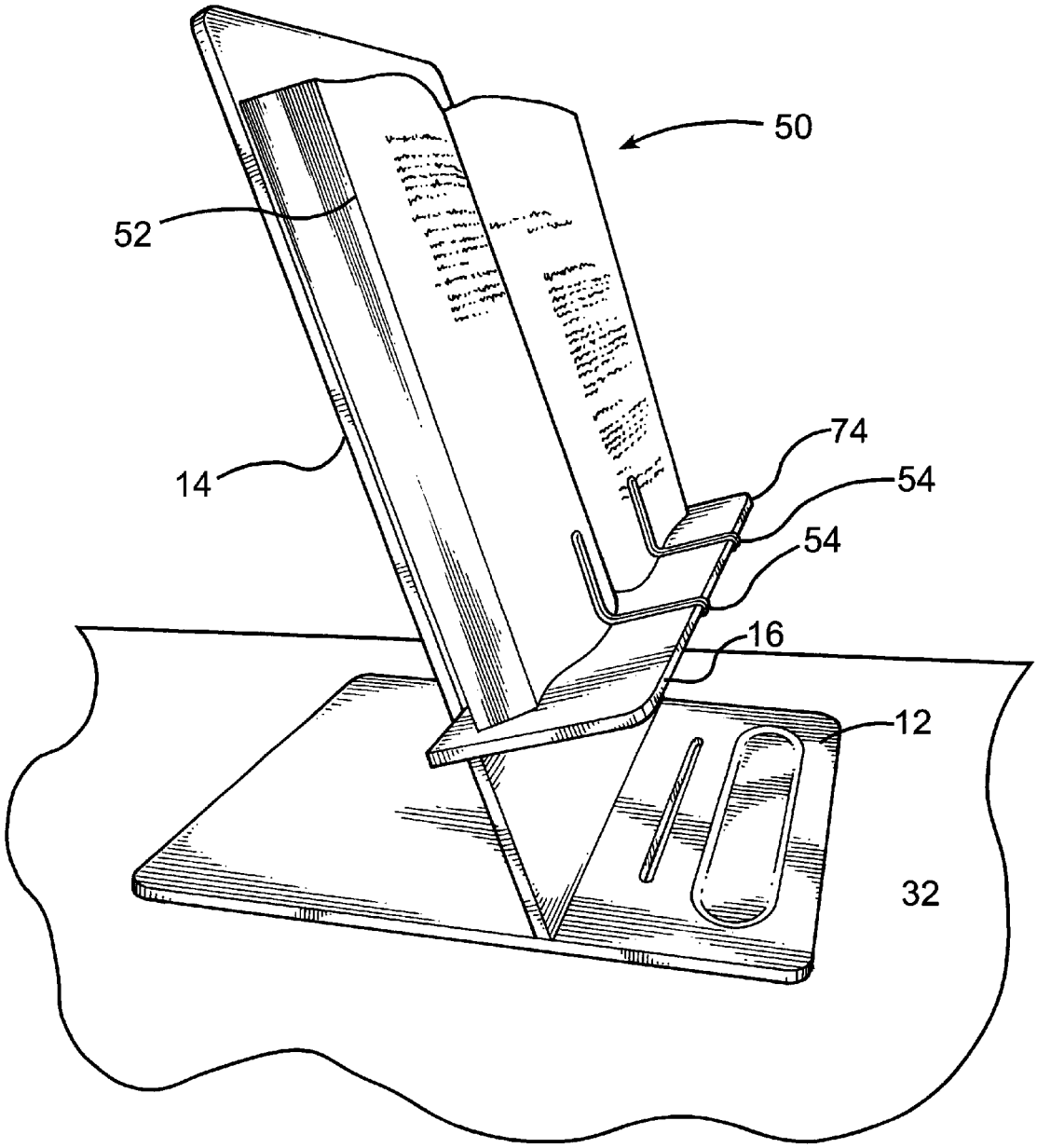
FIG. 8 is a side view of the book on the book and copy holder showing the page stopper clips mounted on the shelf.

As clearly seen in FIGS. 6 and 8, pages 52 may be constrained against random movement by a pair of page stopper clips 54 resiliently clipped to shelf 16. Page stopper clips 54 are shown in a perspective view in FIG. 7A and in a side view in FIG. 7B. Clip 54 is a single piece of wire 56 comprising a U-shaped bend 58, a pair of parallel, vertical arms 60, each of which receive a 90° bend at 62 leading into a pair of horizontal sections 64. Both horizontal sections 64 of wire 56 are then bent 180° at 66 to form a pair of parallel, horizontal sections 68 which terminate at ends 70 after suffering a small bend 72 near ends 70. The distance between bend 62 and horizontal section 68 is slightly less than the thickness 74 (FIG. 8) of shelf 16. Consequently, clip 54 resiliently attaches itself to shelf 16 when placed thereon, as is more clearly evident from FIG. 8. The angular configuration of end 70 relative to sections 68 facilitates the placement of clip 54 onto shelf 16.

Figure 9A:
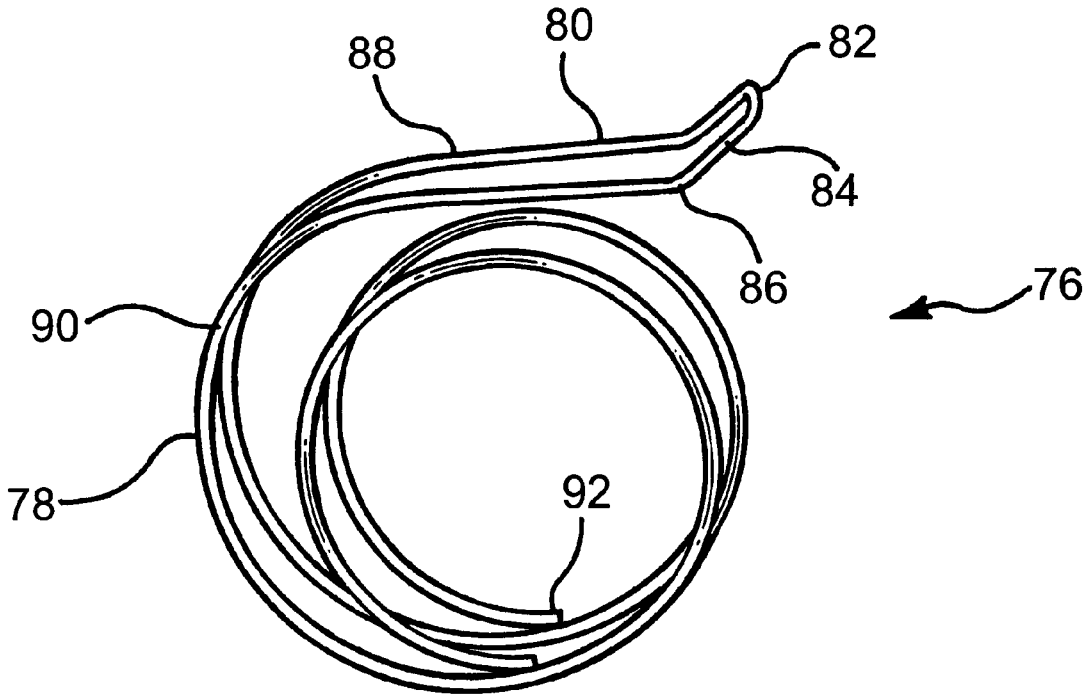
FIG. 9A is a perspective view of a spring clip.
Figure 9B:
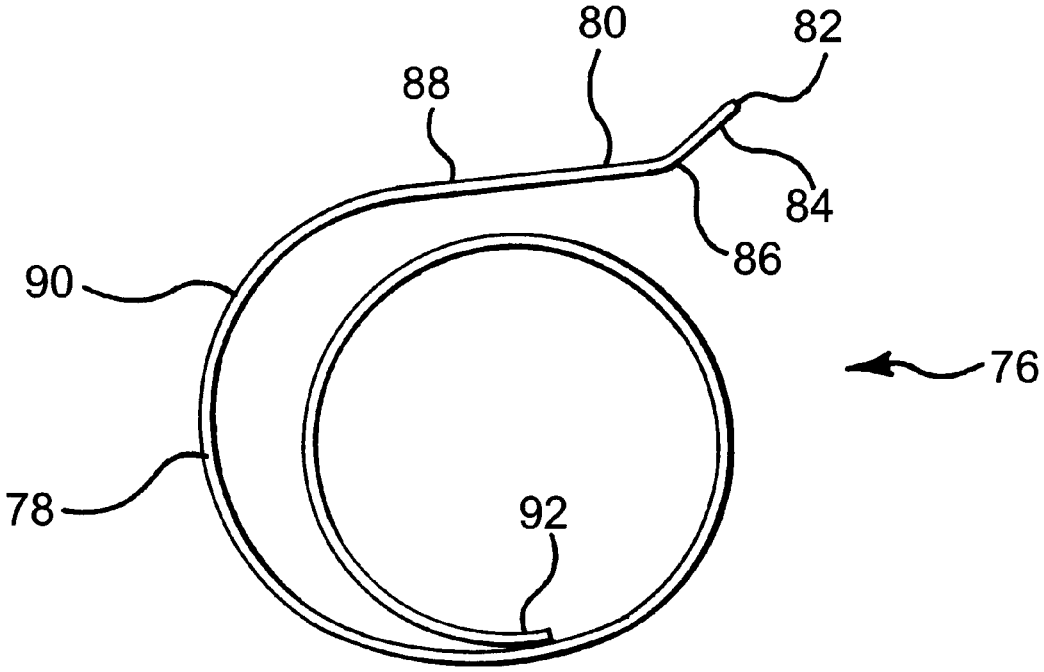
FIG. 9B is a side view of the spring clip.
Figure 10:
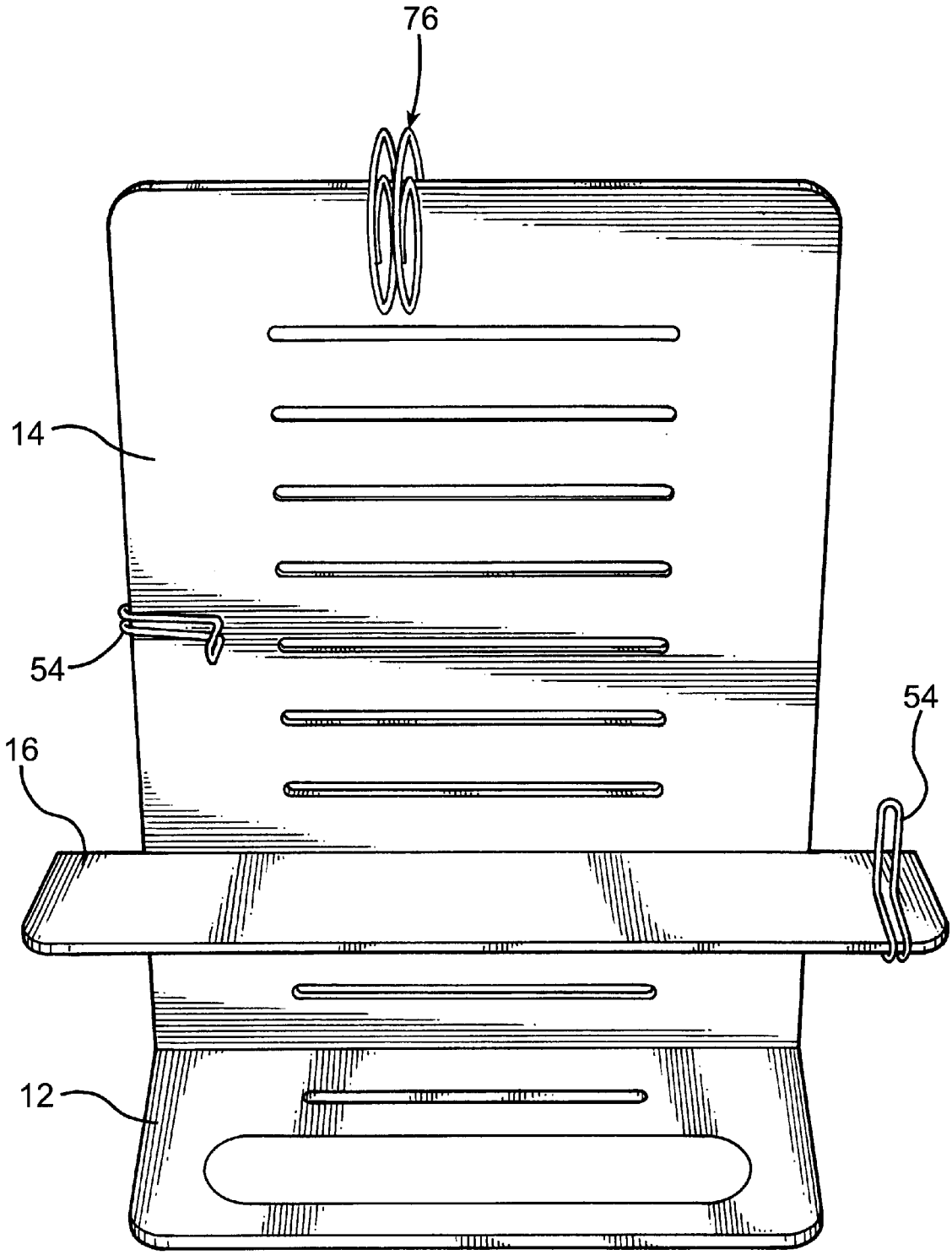
FIG. 10 is an edge view of the rack with the spring clip mounted thereon.
Figure 11:
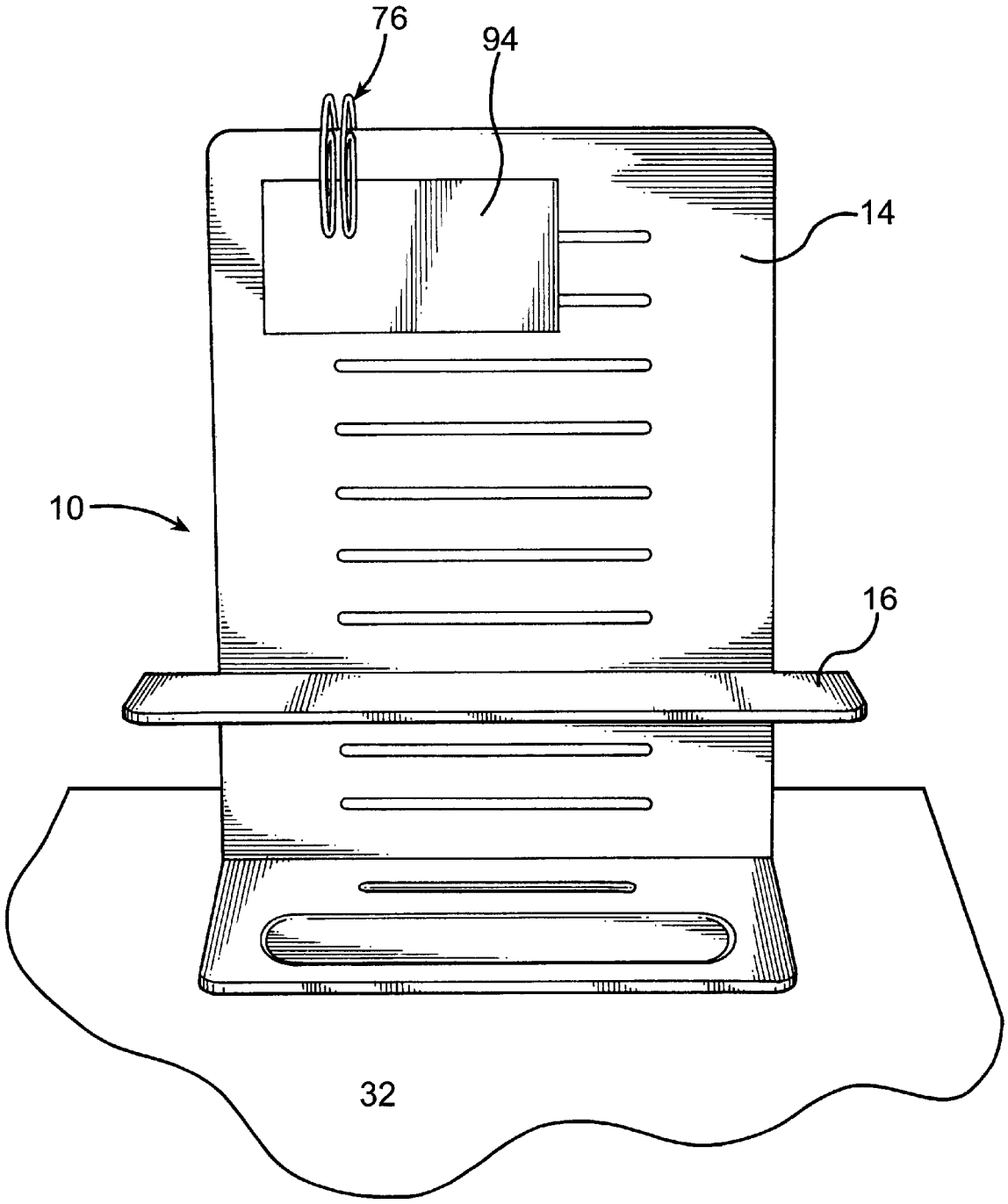
FIG. 11 is a front view of the book and copy holder with the spring clip holding a card on the rack.
Figure 12:
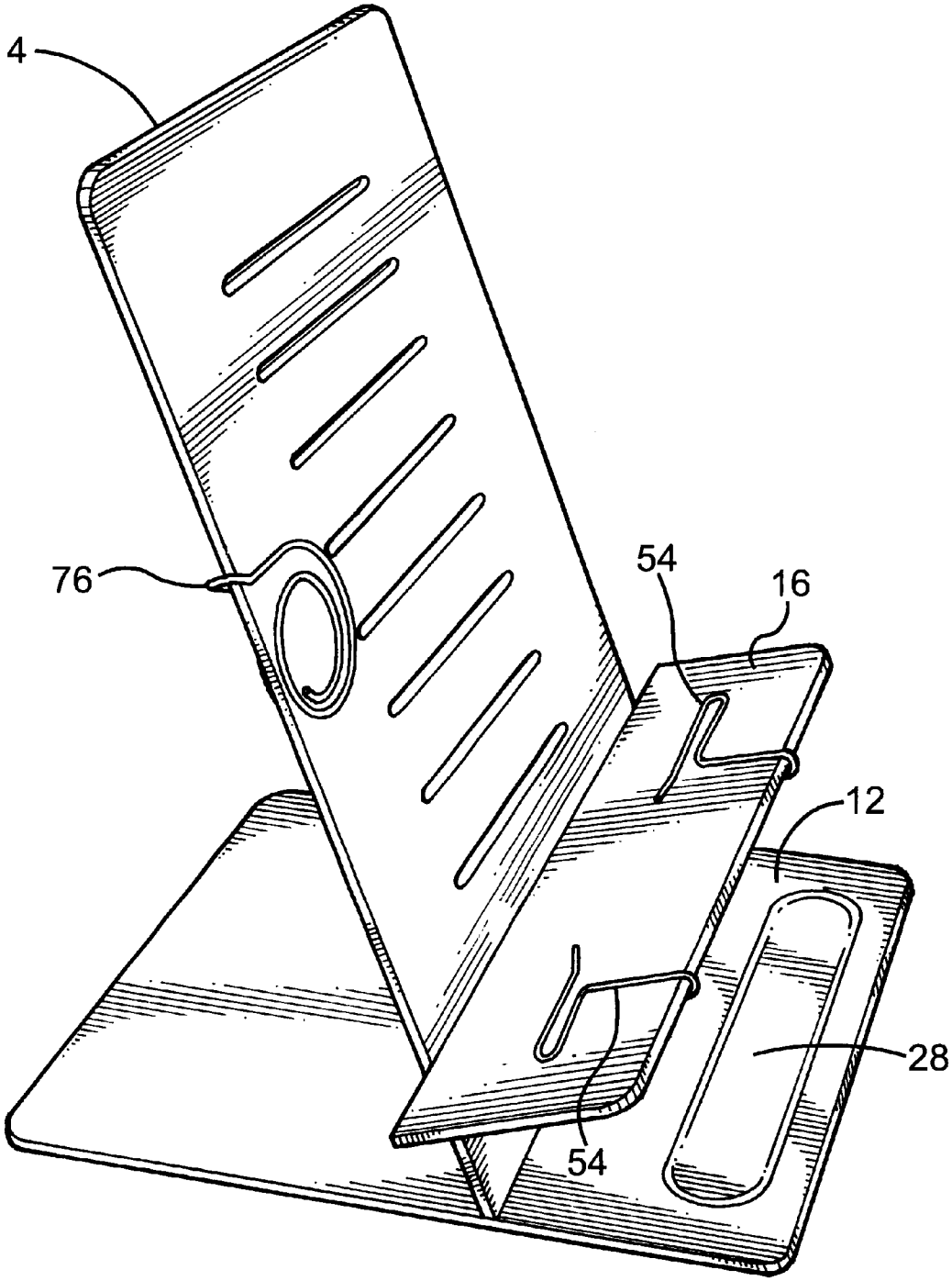
FIG. 12 is a perspective view of the book and copy holder with the pair of page stopper clips stored on the shelf and the spring clip stored on the rack.
Figure 13:
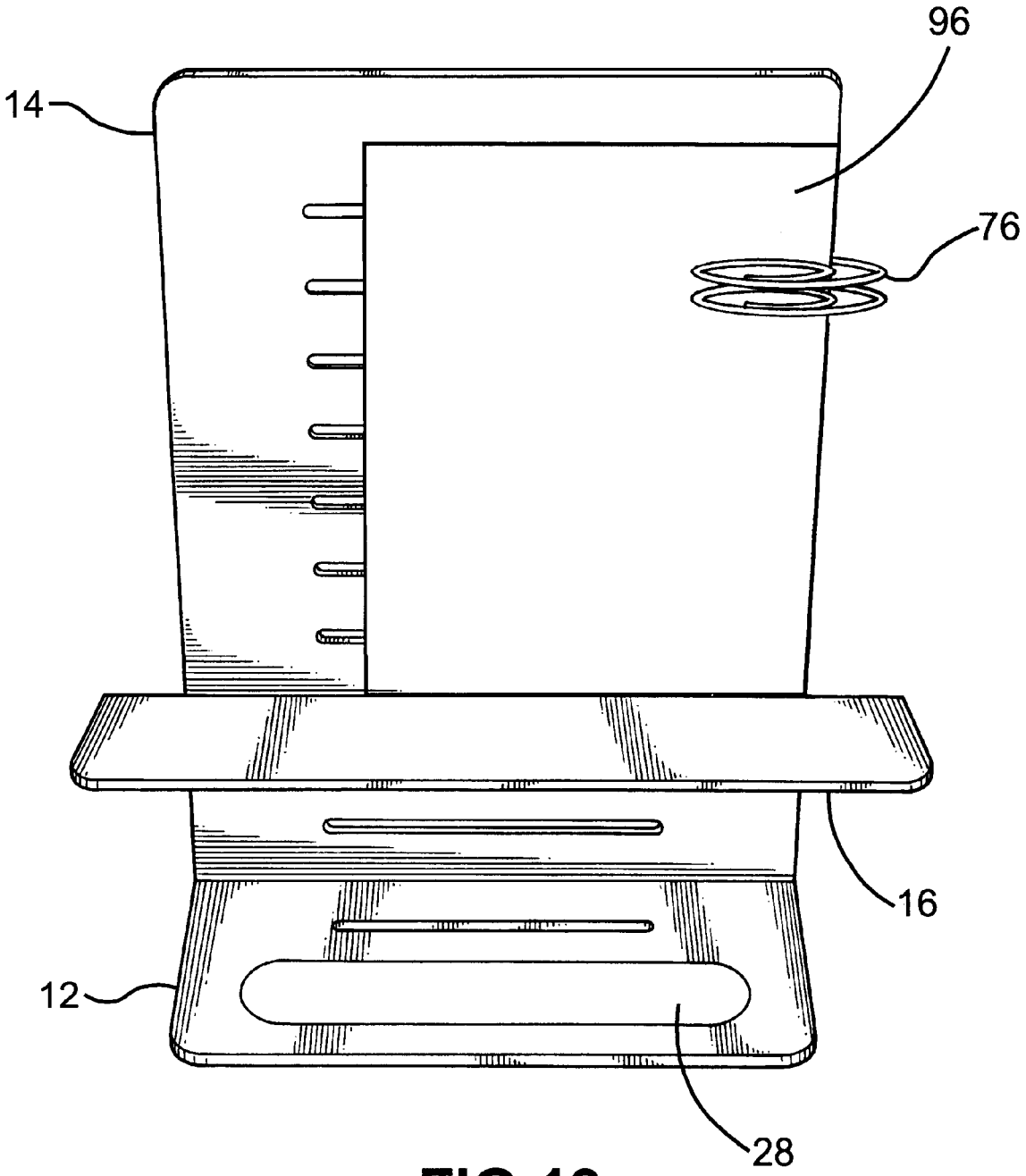
FIG. 13 is a front view showing the spring clip holding a thick card on the book and copy holder.

Another possible accessory to holder 10 is a spring clip 76 shown in FIGS. 9A and 9B. Spring clip 76 comprises a single wire 78 bent into two approximately parallel arms 80 by a U-shaped bend 82. After a short linear segment 84, a slight bend 86 leads into another roughly linear section 88. Arms 80 are then formed into a pair of sections 90 which spiral inwardly through an arcuate angle of preferably over 540° to terminate at ends 92. Spring clip 76 expands to clip onto rack 14, as seen in a side view in FIG. 10, capable of holding sheets to rack 14, e.g., a single card 94 (FIG. 11), or sheet of paper (not shown), or a plurality of sheets up to approximately one inch thick. As with page stopper clip 54, bend 86 allows easy placement of spring clip 76 on holder 10.

Page stopper clips 54 and spring clip 76 may be stored on book and copy holder 10 (FIG. 12) when not in use.

As is readily apparent from the above description of the invention, numerous modifications and variations of the present invention are possible.

We claim as our invention:

1. A book or copy holder, comprising:

a base having a top surface, a bottom surface, and a first slot formed in and extending though said base having first and second ends, said first slot being closed at said first and second ends;

a rack having a top edge, a bottom edge, a front surface, a rear surface, a second slot formed in and extending through said rack having third and fourth ends, and a tab extending from said bottom edge, said second slot being closed at said third and fourth ends, said tab being adapted to be inserted through said first slot; and a shelf having a front edge, a rear edge, and a tab extending from said rear edge, said tab being adapted to be inserted through said second slot.

2. The book or copy holder of claim 1, wherein said base further includes a pencil well.

3. The book or copy holder of claim 1, wherein said base further comprises a third slot, said first and third slots each having a sidewall, said sidewall of said first slot and said sidewall of said third slot extending through said base at different angles relative to the top surface of said base.

4. The book or copy holder of claim 3, wherein said sidewall of said first slot of said base extends though said base at an angle of about 80 degrees relative to said top surface of said base.

5. The book or copy holder of claim 4, wherein said sidewall of said third slot extends though said base at an angle of about 60 degrees relative to said top surface of said base.

6. The book or copy holder of claim 5, wherein said base includes a front edge and said third slot is located between said front edge of said base and said first slot of said base.

7. The book or copy holder of claim 1, wherein said second slot of said rack is elongated and oriented substantially parallel to said top edge of said rack.

8. The book or copy holder of claim 7, wherein said second slot is angled about 90 degrees from said front surface of said rack.

9. The book or copy holder of claim 1, wherein said rack further comprises fourth and fifth slots.

10. The book or copy holder of claim 9, wherein said rack comprises at least ten slots.

11. The book or copy holder of claim 1, wherein the height of said tab of said rack is equal to or greater than the thickness of said base.

12. The book or copy holder of claim 11, wherein said height of said tab of said rack is at least twice the thickness of said base.

13. The book or copy holder of claim 1, wherein the height of said tab of said shelf is equal to or greater than the thickness of said rack.

14. The book or copy holder of claim 13, wherein said height of said tab of said shelf is at least twice the thickness of said rack.

15. The book or copy holder of claim 13, wherein said tab of said shelf includes an aperture for securing said tab within said first slot.

16. The book or copy holder of claim 1, wherein said tab of said shelf is centrally located along said rear edge of said shelf.

17. The book or copy holder of claim 1, wherein said tab of said rack is centrally located along said bottom edge of said rack.

18. A book or copy holder, comprising:

a base having a top surface, a bottom surface, and first and second slots extending through said base, said first and second slots of said base each including a sidewall;

a rack having a top edge, a bottom edge, a front surface, a rear surface, at least one slot formed in and extending through said rack, and a tab which is centrally located on and extending from said bottom edge and is adapted to be inserted through any one of said first and second slots of said base; and a shelf having a front edge, a rear edge, and a tab extending from said rear edge, said tab which is centrally located on said rear edge is adapted to be inserted through any one of said at least one slot of said rack;

wherein:

said sidewall of said first slot of said base forms an angle of about 80 degrees relative to said top surface, said sidewall of said second slot of said base forms an angle of about 60 degrees relative to said top surface;

said at least one slot of said rack includes a sidewall, said sidewall being substantially perpendicular in orientation relative to said front surface;

the height of said tab of said rack is greater than the thickness of said base; and the height of said tab of said shelf is greater than the thickness of said rack.

19. A book or copy holder, comprising:

a base having a top surface, a bottom surface, and a first slot formed in and extending though said base;

a rack having a top edge, a bottom edge, a front surface, a rear surface, a second slot formed in and extending through said rack, and a tab extending from said bottom edge, said tab being adapted to be inserted through said first slot; and a shelf having a front edge, a rear edge, and a tab extending from said rear edge, said tab being adapted to be inserted through said second slot;

wherein said base further comprises a third slot, said first and third slots each having a sidewall, said sidewall of said first slot and said sidewall of said third slot extending through said base at different angles relative to the top surface of said base.

20. The book or copy holder of claim 19, wherein said sidewall of said first slot of said base extends though said base at an angle of about 80 degrees relative to said top surface of said base.

21. The book or copy holder of claim 20, wherein said sidewall of said third slot extends though said base at an angle of about 60 degrees relative to said top surface of said base.

22. The book or copy holder of claim 21, wherein said third slot is located between said front edge of said base and said first slot of said base.

23. A book or copy holder, comprising:

a base having a top surface, a bottom surface, and a first slot formed in and extending though said base;

a rack having a top edge, a bottom edge, a front surface, a rear surface, a second slot formed in and extending through said rack, and a tab extending from said bottom edge, said tab being adapted to be inserted through said first slot; and a shelf having a front edge, a rear edge, and a tab extending from said rear edge, said tab being adapted to be inserted through said second slot;

wherein the height of said tab of said shelf is equal to or greater than the thickness of said rack and said tab of said shelf includes an aperture for securing said tab within one of said at least one slot of said rack.

24. The book or copy holder of claim 23, wherein said tab of said shelf is centrally located along said rear edge of said shelf.

25. A book or copy holder, comprising:

a base having a top surface, a bottom surface, and a first slot formed in and extending though said base;

a rack having a top edge, a bottom edge, front and surfaces located between said top and bottom edges, a second slot formed in and extending through said rack from said front surface to said rear surface, and a tab extending downwardly from said bottom edge, said tab being adapted to be inserted through said first slot; and a shelf having a front edge, a rear edge, and a tab extending from said rear edge, said tab being adapted to be inserted through said second slot.

26. The book or copy holder of claim 25, wherein said top and bottom edges of said rack extend laterally and said second slot is centered laterally on said front surface of said rack.

27. The book or copy holder of claim 26, wherein said first slot is centered laterally on said top surface of said base.

28. The book or copy holder of claim 25, wherein said base further comprises a third slot, said first and third slots each having a sidewall, said sidewall of said first slot and said sidewall of said third slot extending through said base at different angles relative to the top surface of said base.

29. The book and copy holder of claim 25, wherein said rack further comprises fourth and fifth slots, said second, fourth and fifth slots being parallel to one another.

30. The book and copy holder of claim 25, wherein said rack is operationally configured to be disassembled from said base by removing said tab of said rack from said first slot of said base.

31. A book or copy holder, comprising:

a base having a top surface, a bottom surface, and a first slot formed in and extending though said base;

a rack having top and bottom edges extending laterally, front and rear surfaces located between said top edge and said bottom edge, a second slot formed in said rack extending through said front and rear surfaces and being laterally centered on said front surface, and a tab extending downwardly from said bottom edge, said tab being adapted to be inserted through said first slot; and a shelf having a front edge, a rear edge, and a tab extending from said rear edge, said tab being adapted to be inserted through said second slot.

32. The book or copy holder of claim 30, wherein said base further comprises a third slot, said first and third slots each having a sidewall, said sidewall of said first slot and said sidewall of said third slot extending through said base at different angles relative to the top surface of said base.

33. The book and copy holder of claim 30, wherein said rack further comprises fourth and fifth slots, said second, fourth and fifth slots being parallel to one another.

34. A book or copy holder, comprising:

a base having a top surface and a bottom surface;

a rack mounted on said base, said rack having a top edge, a bottom edge, a front surface, a rear surface, a second slot formed in and extending through said rack; and a shelf having a front edge, a rear edge, and a tab extending from and being centered along said rear edge, said tab being adapted to be inserted through said second slot.

* * * * *